United States Patent [19]

Graber

[11] 4,353,140

[45] Oct. 12, 1982

[54] FRAME FOR ELECTRIC BLANKET SUPPORT

[76] Inventor: Wolfram G. Graber, 2002 Norbert St., Spring Hill, Fla. 33526

[21] Appl. No.: 207,005

[22] Filed: Nov. 14, 1980

[51] Int. Cl.[3] ..... A47C 21/02

[52] U.S. Cl. ..... 5/505; 5/506; 108/102; 248/188.1; 248/164; 248/558

[58] Field of Search ..... 5/503, 504, 505, 506, 5/312, 310, 110, 111; 128/24.1; 248/558, 164, 188.1, 439; 108/144, 156, 129, 102

[56] References Cited

U.S. PATENT DOCUMENTS

| | | | |
|---|---|---|---|
| 794,208 | 7/1905 | Weeks | 5/312 |
| 1,072,490 | 9/1913 | Oilar | 5/505 |
| 1,132,061 | 3/1915 | Backer | 5/310 |
| 1,268,327 | 6/1918 | Conrad | 5/505 |
| 1,273,840 | 7/1918 | Fassett | 248/439 |
| 1,309,049 | 7/1919 | Syrett | 5/310 |
| 2,112,122 | 3/1938 | Sullivan | 5/505 |
| 2,696,246 | 12/1954 | Putnam | 108/129 |
| 3,394,666 | 7/1968 | Pearlman | 108/129 |
| 4,312,088 | 1/1982 | Webb | 5/11 |

FOREIGN PATENT DOCUMENTS

| | | | |
|---|---|---|---|
| 380478 | 5/1940 | Italy | 5/110 |
| 796180 | 6/1958 | United Kingdom | 108/144 |

*Primary Examiner*—Alexander Grosz

*Attorney, Agent, or Firm*—John F. McClellan, Sr.

[57] ABSTRACT

An assembly of two sliding portions with respective folding legs comprises a supporting frame deployable on a bed or the like so that infrared radiation may be used from an ordinary electric blanket lifted-away from a sleeper's body, thus freeing the sleeper from body contact with any blanket; the assembly is lightweight and portable and can be set-up for use and folded for storage without any tools, gravitational force being used to hold the subassemblies together.

1 Claim, 3 Drawing Figures

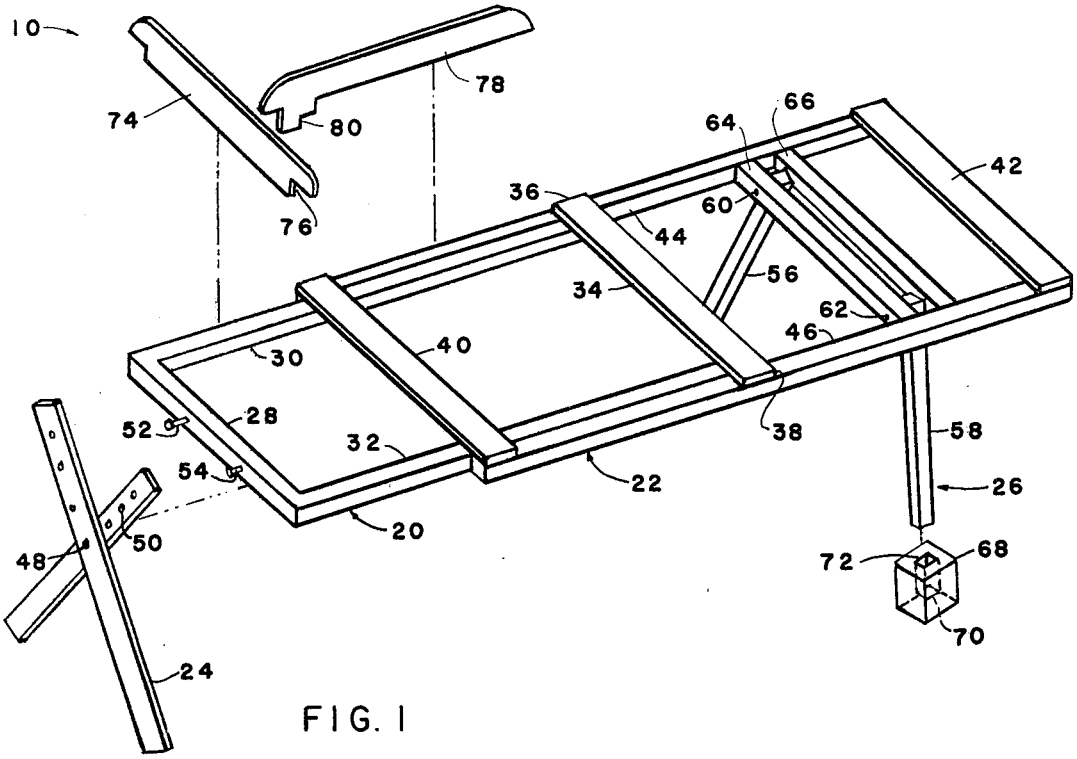
FIG. 1
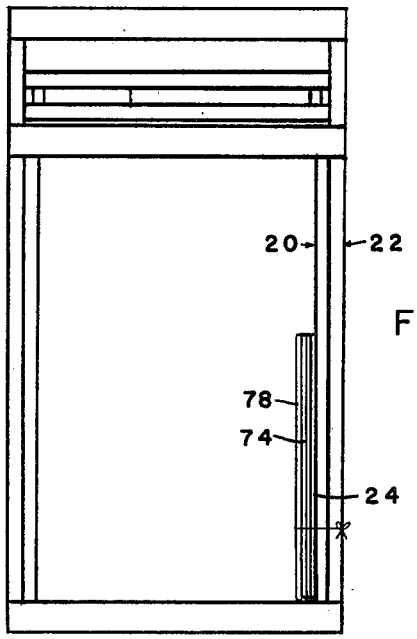
FIG. 3
FIG. 2
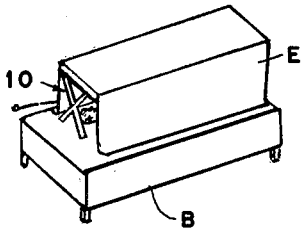

FRAME FOR ELECTRIC BLANKET SUPPORT

This invention relates generally to beds and specifically to a blanket lifting frame for supporting an ordinary electric blanket in position over a bed lifted away from a sleeper's body, freeing the sleeper from any blanket contact.

BACKGROUND OF THE INVENTION

The beneficial effects of heat in treating symptoms of such diseases as arthritis and rheumatism have long been known, but such factors as availability of proper equipment, cost, ventilation, size adjustment, convenience, and weight imposed on the sufferer's body have always been problems.

In the prior art special heating enclosures for the human body have been disclosed, some with frames. However, it is believed that no blanket-lifting frame has been known like that of this invention, particularly with reference to the combination of objects set forth below.

OBJECTS OF THE INVENTION

A principal object of this invention is to provide means of receiving the beneficial infrared radiation from an ordinary electric blanket which is lifted away from all contact with the body of a sleeper on a bed by a blanket lifting frame system that can be set up, and folded to be portable, without any tools.

Further objects are to provide a system as described which is freely and quickly assembled and adjusted in length and height by gravitational force in engagement, so that no tools are needed, to suit various bed sizes and blanket engagements, but which automatically tends to lock itself in adjusted position under the weight of a blanket supported by it.

Still further objects are to provide a system as described which is light in weight but stable in use, which can be used to adjust ventilation past the blanket at selected locations, which provides good access for getting beneath it but which can be assembled over the user by the user, if desired, which is compact and especially easy to store and which is roomy, durable, economical, safe and attractive in appearance.

In brief summary given as cursive description only and not as limitation, the invention comprises first and second sub-assemblies including electric blanket supporting slide members held by gravitational force interlocked, on folding special-design height-adjustable legs, in selected adjustment position, the holding force increased by weight of any electric blanket used; as preferred features the invention has adjustable detachable blanket-support and ventilation adjustment members.

The above and other objects and advantages of this invention will become more readily apparent on examination of the following description, including the drawings, in which like reference numerals refer to like parts:

FIG. 1 is a partially-exploded perspective view of a preferred embodiment of the invention;

FIG. 2 is a perspective view of the invention in use supporting an electric blanket; and FIG. 3 shows the invention collapsed for storage.

DETAILED DESCRIPTION

FIG. 1 is a perspective view of the invention 10 and FIG. 2 shows the invention in use supporting an electric blanket E over a bed B, with user inside. Dimensionally the invention is about as long when extended fully as the bed on which it is to be used, and almost as wide as a single bed, although it can be made to fit larger beds.

A first slide 20 gravitationally interlocks with a second slide 22 for easy, quick assembly, disassembly and adjustment of the assembly without any tools, including provision for support by first and second sets of manually adjustable legs 24, 26, both sets of which fix in a position and in adjustment gravitationally. As will be seen, the interlock is an overlapping clasping of the headward end of the second slide over the mid-portion of the first slide coupled with clasping of the footward end of the first slide over the mid-portion of the second slide. The slides are thus in-plane, but with the bottom of each free of constraint by the other so that they can be separated and handled separately for lightness in weight, ease in storage, and the like.

The first slide 20 comprises a rectangular, rigid structure of head end-piece 28 with identical left and right sides 30, 32 joined in-plane to it making the shape of a square "U", and at the footward end an engaging member in the shape of a "T" bar 34 or straight member fixed across the otherwise-open end of the "U" on the upper face of the sides, with the ends 36, 38 of the "T" bar extending past the sides a distance outward sufficient to engage the second slide 22, which lies outside the first slide.

The second slide 22 comprises a rectangular rigid assembly of headward end or engaging end 40 and foot end 42 in the form of a pair of identical straight members transversely affixed across respective ends of a pair of identical side guides 44, 46 on the upper face of the side guides.

Supporting the headward end of the first slide and the footward end of the second slide thus forms a stable, slidably adjustable clasping or interlock of the two slides 20, 22, which support each other in the middle.

To support the headward end of the first slide adjustably the set of legs 24 is a pair of scissor-legs 24 pivoted at an intermediate point by a fastener such as a rivet 48 or other suitable fastener. For the securance with height adjustment, a length-matched series of holes 50 in each scissor-leg permits adjustable attachment to a pair of headed fixed studs or nails 52, 54 outwardly projecting longitudinally from the head-end piece 28. The studs pass through a respective set of holes and then the stud heads prevent withdrawal as the weight of the assembly forces the stud heads down relative to the holes to an overlap with the lower margin of the holes, the studs being just long enough relative to fit of the scissors-legs for frictional retention. This adjustment is conveniently at hand to one lying on the bed. Height-adjustment is preferred but it will be evident that each scissor-leg could have only one hole instead. As shown, the lower ends may be transverse to the length, with the corners giving a non-skid effect on bedding.

To support the foot end of the assembly, the set of legs 26 comprises a pair of folding legs 56, 58, pivoted respectively by pins at 60, 62 between a pair of parallel-spaced bridging members 64, 66 fixed transversely within the side guides 44, 46.

Unfolded, each leg comes to rest in an outwardly splayed position against a respective side or side-guide of the second slide, limiting unfolding to a predetermined angle. Preferably two bridging members are used for better support against longitudinal loading of the assembly transmitted through the legs, although one alone would function but might require heavier frame members, legs and pivots.

Folded, these legs overlap, nearly in-plane, in the center. Preferably these legs are located about one-foot (0.3 m) from the foot end of the assembly, so that the cantilever end can provide tolerance in longitudinal location of the assembly on a bed and to permit hanging an electric blanket free of the end of the bed for ventilation, if desired.

Height adjustment of the legs 56, 58 can be made by means of rigid shoes 68 with raised bottom 70 and top socket 72; these may be of plywood or plastic or the like proportioned for frictional fit over the lower ends of the legs to extend the legs.

Ventilation can also be adjusted at head end of the assembly. The electric blanket headward end can be supported on detachable arched transverse-crosspiece 74 which has a notch 76 at each end to fit and hold in place transversely across the slides at any clear location selected within the full length of the first slide 20. Part 74 serves also as support for a veil (towel) for closing the heating space at the head end. Similarly ventilation and blanket support can be provided by detachable longitudinal piece 78 which has a notched downward extension 80 to fit onto the frame and particularly crosspiece 74 and raise a blanket portion, thus forming a triangular opening at the head end.

FIG. 3 shows the invention collapsed for storage; legs 24 folded, the two slides 20, 22 completely overlapping, first within the second, and the scissor legs 34 and crosspiece 74 and longitudinal piece 78 bundled together and tied or taped to a slide.

Materials for the invention may be at the simplest pine wood nailed or glued together, the sides 30, 32 and side guides 44, 46 and legs being in section as light as ¾ inch square (18 mm square) and the broader pieces in section 1 by ¼ inch (25×6 mm) although plastic or aluminum tubing construction would be satisfactory. Extended length, width and minimum height may be respectively 2 feet by 6 feet by 18 inches (60 cm by 1.8 m by 45 cm).

To sum up, from the above it will be appreciated that for the benefit of invalids and others with impaired dexterity or mobility, the invention holds in position not with tool-operated fassteners but under force of gravity, and that the weight of a blanket would tend to increase the holding force, at the scissors-legs at the head end, at the deployed or splayed position of the legs at the foot end, in the shoe height adjustment, and in the positioning of the transverse and longitudinal electric blanket adjustable supports, and that the invention is easily manipulated, economical and convenient.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A frame deployable for electric blanket support above a bed or the like to provide infrared radiation for a sleeper without any blanket contact with the sleeper, and foldable for storage, including, in combination: a first slide with a headward end and a footward end, a second slide with a headward end and a footward end, tool-free means for slidably deploying the first and second slides for electric blanket supporting comprising: means for clasping together under gravitational force the headward end of the second slide and the footward end of the first slide, including first and second means manually adjustable for respectively supporting the headward end of the first slide and the footward end of the second slide; wherein the means for clasping comprise: the first and second slides being rectangular in form with respective sides, the first slide fitting in-plane between the sides of the second slide and having at the footward end thereof a transverse projection over the sides of the second slide, the headward end of the second slide having a transverse projection over the sides of the first slide; and means permitting ready separation of said first and second slides, comprising the bottom of said first slide being free of constraint by the second slide and the bottom of the second slide being free of constraint by the first slide.

* * * * *